US006702614B2

(12) United States Patent
Nakamura et al.

(10) Patent No.: US 6,702,614 B2
(45) Date of Patent: Mar. 9, 2004

(54) CONNECTOR WITH LOCK CONFIGURED TO AVOID INTERFERENCE WITH TERMINAL FITTING

(75) Inventors: Hideto Nakamura, Yokkaichi (JP); Ryotaro Ishikawa, Yokkaichi (JP); Hajime Kawase, Yokkaichi (JP); Yuuichi Nankou, Yokkaichi (JP); Naoya Kurimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/271,802

(22) Filed: Oct. 15, 2002

(65) Prior Publication Data

US 2003/0190841 A1 Oct. 9, 2003

(30) Foreign Application Priority Data

Apr. 7, 2002 (JP) ..... 2002-196441
Jul. 23, 2002 (JP) ..... 2002-213636

(51) Int. Cl.[7] ..... H01R 13/40
(52) U.S. Cl. ..... 439/595; 439/748
(58) Field of Search ..... 439/744, 745, 439/746, 748, 595

(56) References Cited

U.S. PATENT DOCUMENTS 5,235,743 A 8/1993 Endo et al.
5,240,434 A * 8/1993 Yagi et al. ..... 439/595
5,630,733 A * 5/1997 Jinno et al. ..... 439/595
5,733,144 A * 3/1998 Tsuji et al. ..... 439/595
5,885,105 A * 3/1999 Takagishi et al. ..... 439/595
6,341,985 B2 1/2002 Kodama
6,364,705 B1 * 4/2002 Yamamoto ..... 439/595

FOREIGN PATENT DOCUMENTS

EP 1 073 154 1/2001
EP 1 209 766 5/2002

* cited by examiner

*Primary Examiner*—Javaid H. Nasri
*Assistant Examiner*—Thanh-Tam Le
(74) *Attorney, Agent, or Firm*—Anthony J. Casella; Gerald E. Hespos

(57) ABSTRACT

A connector has a housing (40) with cavities (41) and resiliently deformable locks (43) that project into the cavities (41). Terminal fittings (10) are insertable into the cavities (41) and deform the locks (43) in a deforming direction (DD) that intersects the inserting and withdrawing directions (IWD) of the terminal fitting (10). The locks (43) then restore and locking surfaces (64) of the locks (43) lock the terminal fittings (10) in the cavities (41). Each locking surface (64) has an upper locking surface (58) furthest into the cavity (41) and a lower locking surface (61). The lower locking surface (61) is at an obtuse angle to the withdrawing direction of the terminal fitting (10), whereas an angle of the upper locking surface (58) to the withdrawing direction is smaller than the angle of the lower locking surface (61).

10 Claims, 17 Drawing Sheets

CONNECTOR WITH LOCK CONFIGURED TO AVOID INTERFERENCE WITH TERMINAL FITTING

BACKGROUND OF THE INVENTION

1. Field of the Invention

The present invention relates to a connector.

2. Description of the Related Art

A known connector is disclosed in U.S. Pat. No. 5,235,743 and also is illustrated in FIG. 17 herein. With reference to FIG. 17, the connector has a housing 1 and a terminal fitting 2 inserted from behind into a cavity 3 of the housing 1. The housing 1 has a lock 4 that defines the bottom of the cavity 3. The lock 4 has a long arm 4*a* that is resiliently deformable along the vertical direction. A fastening projection 4*b* projects from the upper surface of the arm 4*a* and is fittable into a hole 2*a* in the bottom wall of the terminal fitting 2 to engage the edge of the hole 2*a*.

The connector of FIG. 17 can be miniaturized by reducing the size of all components. However, the smaller lock 4 is weaker and may be deformed by an excessive pulling force on the locked terminal fitting 2. As a countermeasure, a locking surface 5 of the fastening projection 4*b* can be inclined at an obtuse angle with respect to a withdrawing direction, as shown in FIG. 18. This inclination of the locking surface 5 causes a component of the pulling force on the locked terminal fitting 2 to act in a direction opposite from the deforming direction. Thus, the lock 4 is difficult to disengage, and the force to lock the terminal fitting 2 can be increased.

The inclination of locking surface 5 creates problems when the terminal fitting 2 is being detached. Specifically, the terminal fitting 2 is detached by forcibly deforming the lock 4 with a disengagement jig. However, the locking surface 5 is inclined forward toward its upper end and a trace of displacement of the locking surface 5 during the resilient deformation is more forward than that of FIG. 17. Thus, the locking surface 5 is more likely to interfere with the edge of the locking hole 2*a* when the lock 4 is deformed.

The invention was completed based on the above problem and an object thereof is to improve a detaching operability of a terminal fitting while in particular allowing to secure a sufficient force to lock the terminal fitting.

SUMMARY OF THE INVENTION

The invention is directed to a connector with a housing that has at least one cavity and at least one terminal fitting that can be inserted into the cavity. A resiliently deformable lock is in the cavity and is contacted by the terminal fitting as the terminal fitting is inserted into the cavity. The contact by the terminal fitting causes the lock to deform in a deforming direction that intersects the inserting and withdrawing directions of the terminal fitting. The lock restores resiliently when the terminal fitting is inserted completely, and locks the terminal fitting in the cavity. The lock has a locking surface for engaging the terminal fitting. The locking surface comprises a deforming-direction front section at the front side relative to the deforming direction of the lock and a deforming-direction rear section at the backside relative to the deforming direction. An angle of the deforming-direction rear section to the withdrawing direction of the terminal fitting is smaller than an angle of the deforming-direction front section to the withdrawing direction.

Accordingly, the terminal fitting can be detached from the connector housing by forcibly deforming the lock away from the terminal fitting and pulling the terminal fitting back. The angle of the deforming-direction rear section to the withdrawing direction is smaller than the angle of the deforming-direction front section thereto. Thus, a trace of displacement of the locking surface during the resilient deformation of the lock is more backward as compared to a case where the locking surface has the same angle of inclination over the entire length. Thus, the lock is less likely to interfere with the terminal fitting during resilient deformation, and detachment of the terminal fitting is reliable.

The deforming-direction front section preferably is inclined at an obtuse angle to the withdrawing direction of the terminal fitting.

The terminal fitting inserted into the cavity of the connector housing is held so as not to come out by the lock. The deforming-direction front section of the locking surface of the lock is inclined at an obtuse angle to the withdrawing direction of the terminal fitting. Thus, even if a force acts to pull the terminal fitting back in its locked state, a component of the force acts on the lock in a direction opposite from the deforming direction, making it difficult to disengage the lock. Therefore, a force to lock the terminal fitting can be increased.

The angle of the deforming-direction rear section may be substantially normal to the inserting and withdrawing directions of the terminal fitting.

The terminal fitting may comprise a locking projection that engages the deforming-direction front section of the locking surface for locking. The deforming-direction front section preferably is inclined in the same direction as a locking section of the terminal fitting.

The lock preferably is supported at both ends. Thus, a high strength can be maintained even if the thickness is reduced as compared to conventional locks supported only at one end and. Accordingly, a force to lock the terminal fitting can be enhanced, and the connector suited to being miniaturized can be provided.

The housing preferably has a forward opening for forming the locking surface of the lock. A section of the lock that projects more forward than the locking surface is connected with at least one side surface of the opening. The connected section does not hinder the formation of the locking surface, and enables the locking surface to be wider. Thus, even if the connector is miniaturized, a sufficient locking force can be secured for the terminal fitting. Thus, the connector is suited to being miniaturized.

The section of the lock that projects more forward than the locking surface preferably is formed with a manoeuvrable groove that opens forward and is manoeuvrable by a disengagement jig to deform the lock. The disengagement jig preferably can be inserted into the opening for manoeuvring the manoeuvrable groove. Most preferably, jig-introducing groove forks or divides the section of the lock projecting more forward than the locking surface.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector in accordance with the invention has female terminal fittings 10 mounted in a female housing 40, as shown in FIGS. 1 to 16. The female housing 40 is connectable with an unillustrated male housing so that the female terminal fittings 10 are electrically connectable with unillustrated male terminal fittings in the male housing. In the following description, directions of inserting and withdrawing the female terminal fittings 10 into and from the female housing 40 are referred to as forward and backward directions, respectively, and reference is made to FIG. 7 concerning the vertical direction.

Figure 4:
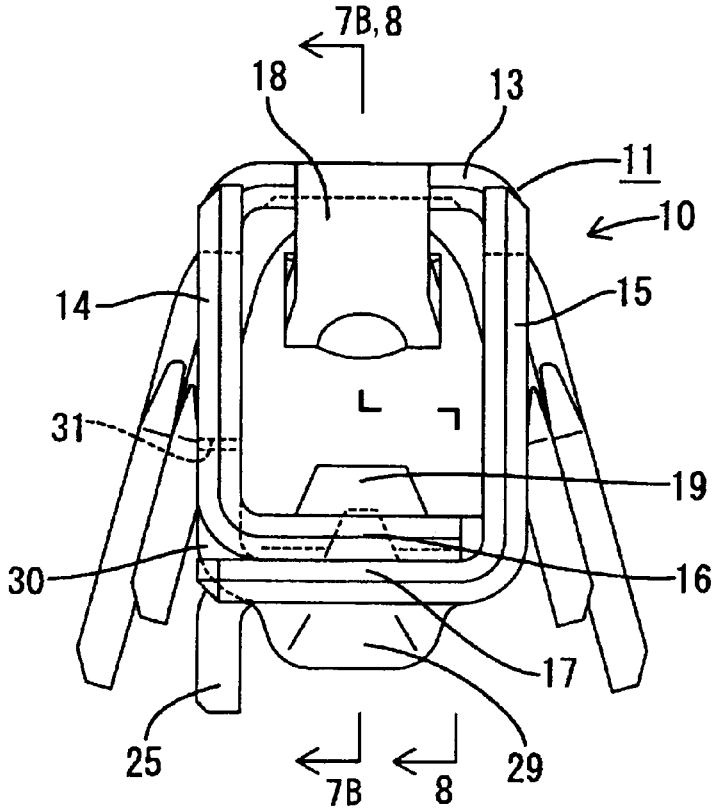
FIG. 4 is a front view of a female terminal fitting.
Figure 5:
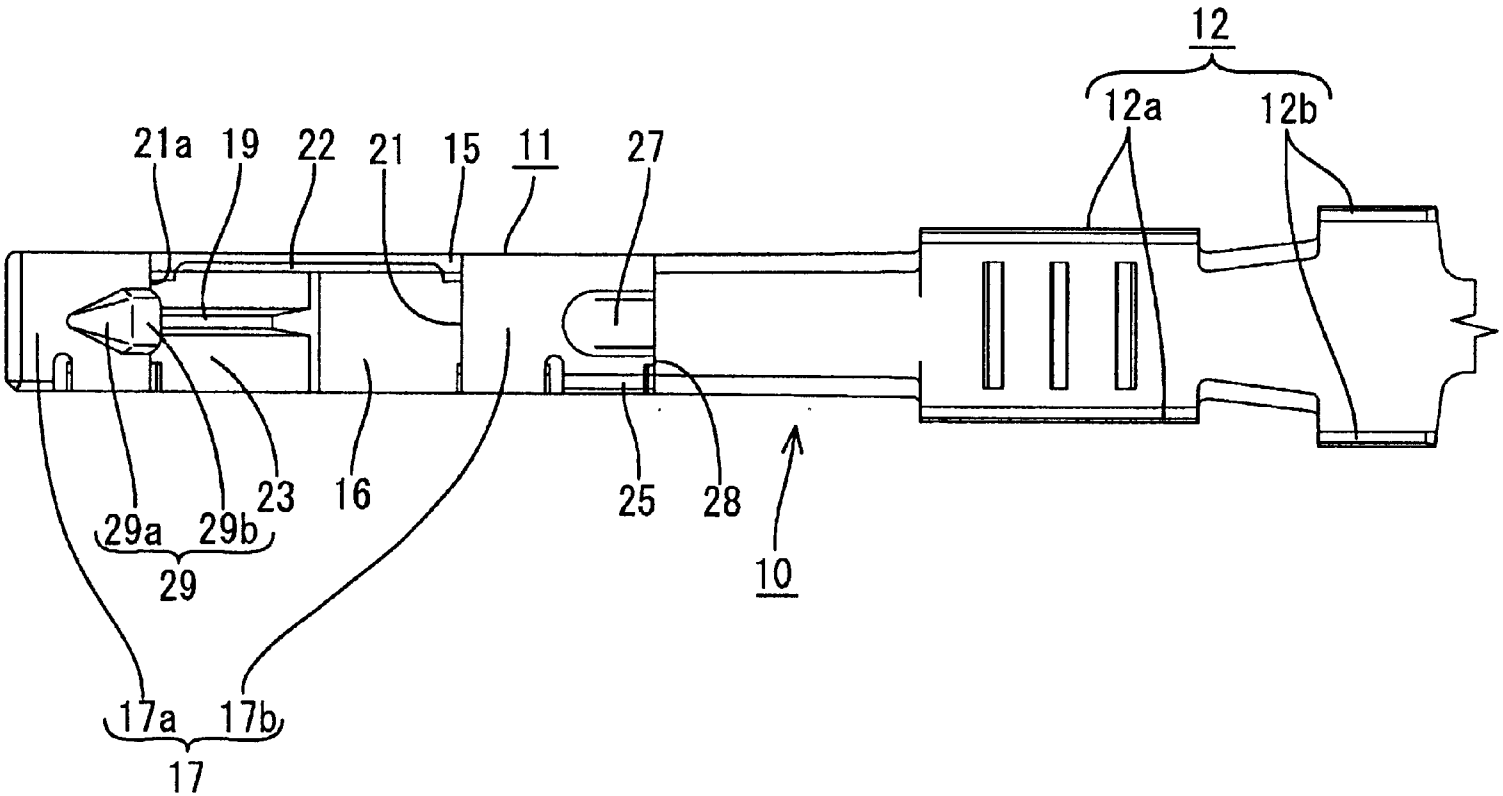
FIG. 5 is a bottom view of the female terminal fitting.

The female terminal fitting 10 is formed by embossing, folding and/or bending a metallic material that has been stamped or cut into a specified shape. The female terminal fitting 10, as shown in FIGS. 4 and 5, has a main body 11 substantially in the form of a box with open front and rear ends and a barrel 12 to be crimped, bent or folded into connection with an end of a wire W. The barrel 12 has a front pair of crimping pieces 12*a* for crimped connection with a core Wa of the wire W, and a rear pair of crimping pieces 12*b* for crimped connection with an insulated portion Wb of the wire W.

The main body 11 has a ceiling wall 13 that extends in forward and backward directions, left and right sidewalls 14, 15 that extend down from opposite lateral edges of the ceiling wall 13, a bottom wall 16 that extends from the projecting end of the left sidewall 14 of FIG. 4 to face the ceiling wall 13, and an outer wall 17 that extends from the projecting end of the right sidewall 14 of FIG. 4 to be placed below and outside the bottom wall 16.

Figure 7:
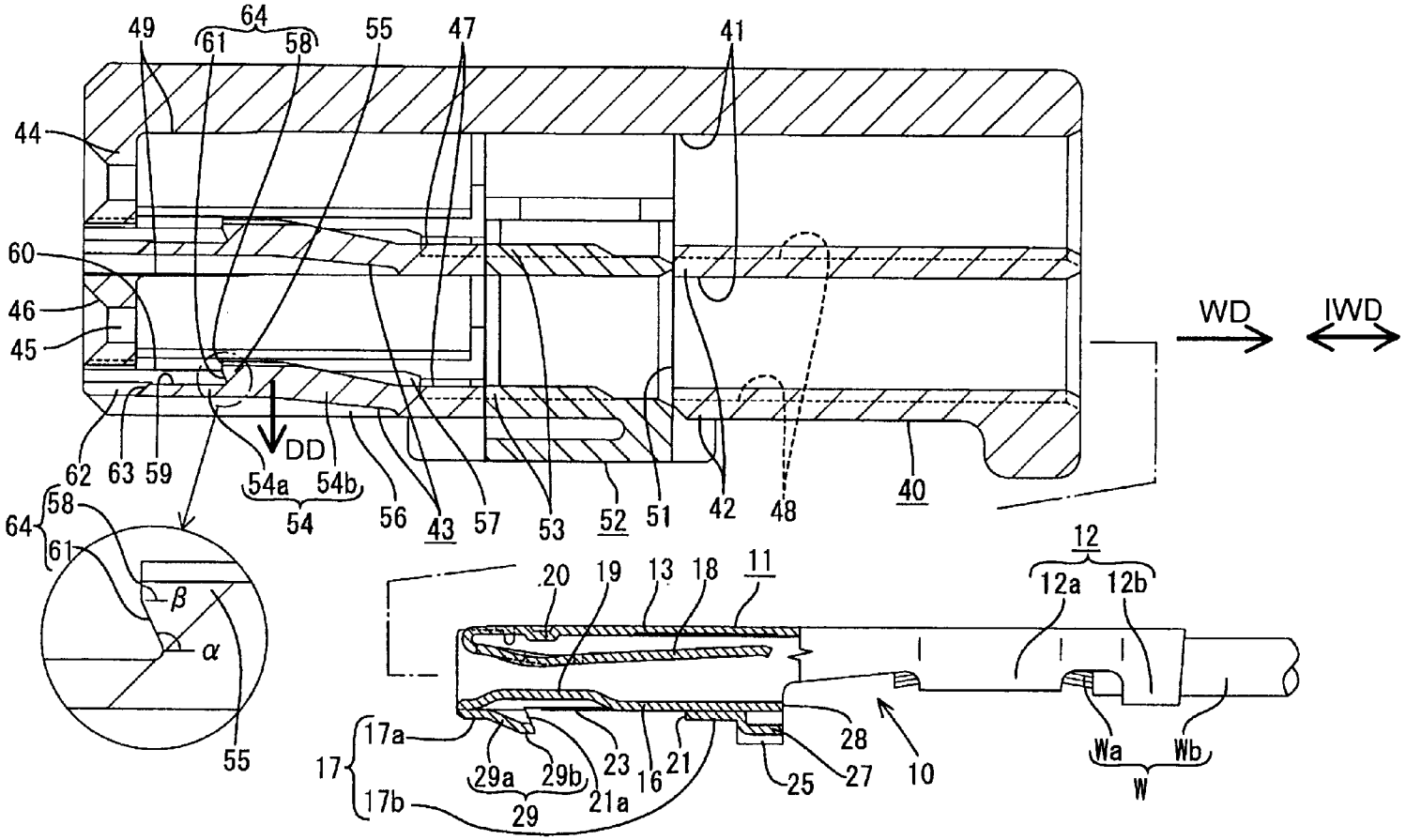
FIG. 7 is a cross sectional view of the female housing taken along 7A—7A of FIG. 1 and of the female terminal fitting taken along 7B—7B of FIG. 4 showing a state before the female terminal fitting is inserted into the female housing with a retainer mounted at a partial locking position.

The front end of the ceiling wall 13 is retracted back as compared to the front ends of the other walls 14, 15, 16 and 17, and a resilient contact piece 38 projects from this front end as shown in FIG. 7. The resilient contact piece 18 is formed from a tongue that extends from the front end of the ceiling wall 13 and is folded to face the ceiling wall 13 and the bottom wall 16. Thus, the resilient contact piece 18 is supported only at one end and has a substantially triangular shape. The resilient contact piece 18 can be brought resiliently into contact with a tab of a mating male terminal fitting inserted into the main body 11 from the front. A receiving portion 19 projects in from the bottom wall 16 substantially facing the resilient contact 18. The receiving portion 19 can hold the tab while squeezing it in cooperation with the resilient contact piece 18. An excessive deformation preventing projection 20 is embossed in the ceiling wall 13 and projects toward the resilient contact 18. Engagement of the resilient contact piece 18 with the excessive deformation preventing projection 20 prevents deformation of the resilient contact piece 18 beyond its resiliency limit.

A cut-away portion 21 divides the outer wall 17 into front and rear portions 17*a* and 17*b*, as shown in FIGS. 5 and 7. The cut-away 21 is formed over substantially the entire width of the outer wall and is substantially at its longitudinal middle. The front cut end surface 21*a* of the cut-away portion 21 is inclined up and to the back over its entire area. The cut-away portion 21 is slightly shorter than half the length of the outer wall 17 and extends up to the bottom end of the sidewall 15 at the upper side in FIG. 5. A bulging piece 22 extends from the projecting end of the bottom wall 16 and contacts the bottom end surface of the sidewall 15 to hold the bottom wall 16 substantially horizontally. The entire area of the bottom wall 16, except a contact portion of the bulging piece 22 with the sidewall 15, is slightly lower than this contact portion, thereby increasing a depth of engagement with the lock 13. The front portion 17*a* of the outer wall 17 is slightly shorter than the rear portion 17*b* in forward and backward directions.

Figure 6:
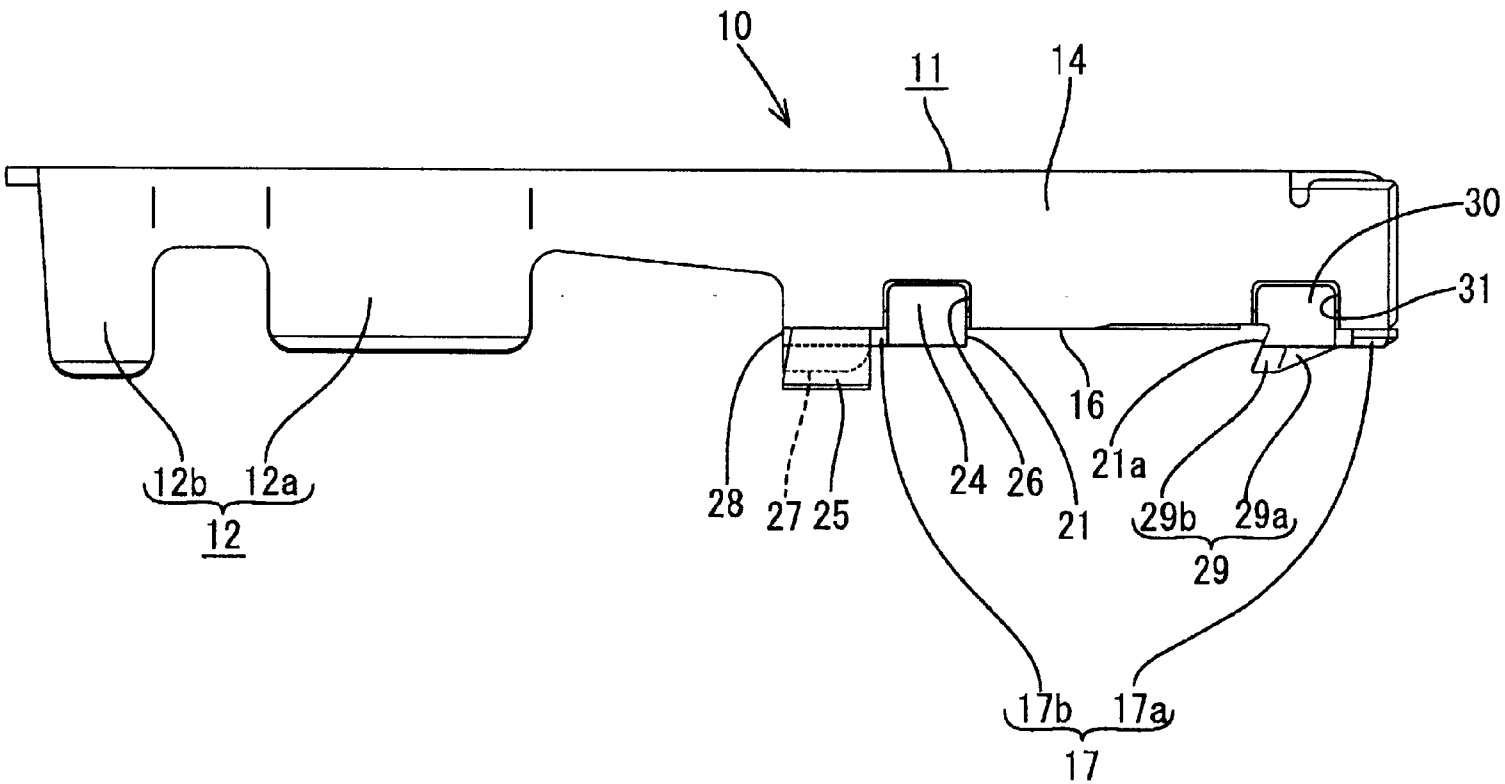
FIG. 6 is a left side view of the female terminal fitting.

A rear-portion holding piece 46 is bent up from the projecting end of the rear portion 37*b* of the outer wall 37, as shown in FIG. 6, and fits into a rear portion holding groove 48 to prevent loose forward and backward movement of the rear portion 37*b*. A stabilizer 47 is bent down from the projecting end of the rear portion 37*b* of the outer wall 37 and fits in the stabilizer-inserting groove 20 to guide the insertion of the female terminal fitting 30 into the cavity 11. The front end of the rear-portion holding piece 46 and the front end of the rear portion 37*b* are substantially aligned with each other. Similarly, the rear end of the stabilizer 47 and the rear end of the rear portion 37*b* are substantially aligned with each other. A projection 49 is embossed to project out at the widthwise center of the rear end of the rear portion 37*b* and has a length substantially equal to the length of the stabilizer 47.

A locking projection 29 is embossed out from the front portion 17*a* of the outer wall 17 at a position displaced slightly to the left of center in FIG. 4 and adjacent the front cut end of the cut-away portion 21. The locking projection 29, as shown in FIGS. 5 and 6, is tapered so that the width and height of the locking projection 29 gradually decrease toward a vertex at the front end. More particularly, the locking projection 29 has a pyramid portion 29*a* formed by three slanted surfaces and a rectangular tube portion 29*b* with a substantially constant width and height and formed by three sequentially connected side surfaces. The pyramid portion 29*a* of the locking projection 29 is tapered and has a slightly rounded front end. The rectangular tube portion 29*b* of the locking projection 29 overhangs back substantially along the inclination of the front cut end surface 21*a* of the cut-away portion 21 and projects more back towards the cut-away portion 21 than the front portion 17*a* of the outer wall 17.

The locking projection 29 projects up to substantially the same height as the projection 27. The rear end of the locking projection 29 is formed by the front cut end surface 21*a* of the cut-away portion 21, which inclines in and up to the back. The rear end surfaces of the front portion 17*a* of the outer wall 17 at opposite sides of the locking projection 29 also are formed by the inwardly and upwardly inclined front cut end surface 21*a*.

A front-portion holding piece 30 is bent up from the projecting end of the front portion 17*a* of the outer wall 17 and fits into a front-portion holding groove 31 in the side wall 14, as shown in FIG. 6, to prevent the front portion 17*a* from making loose forward and backward movements. The front-portion holding piece 30 projects more backward than the front portion 17*a* of the outer wall 17. The cut-away portion 21 extends into the base end of the front-portion holding piece 30, and the cut end surface 44*a* thereof is inclined in and up to the back as already described.

Figure 1:
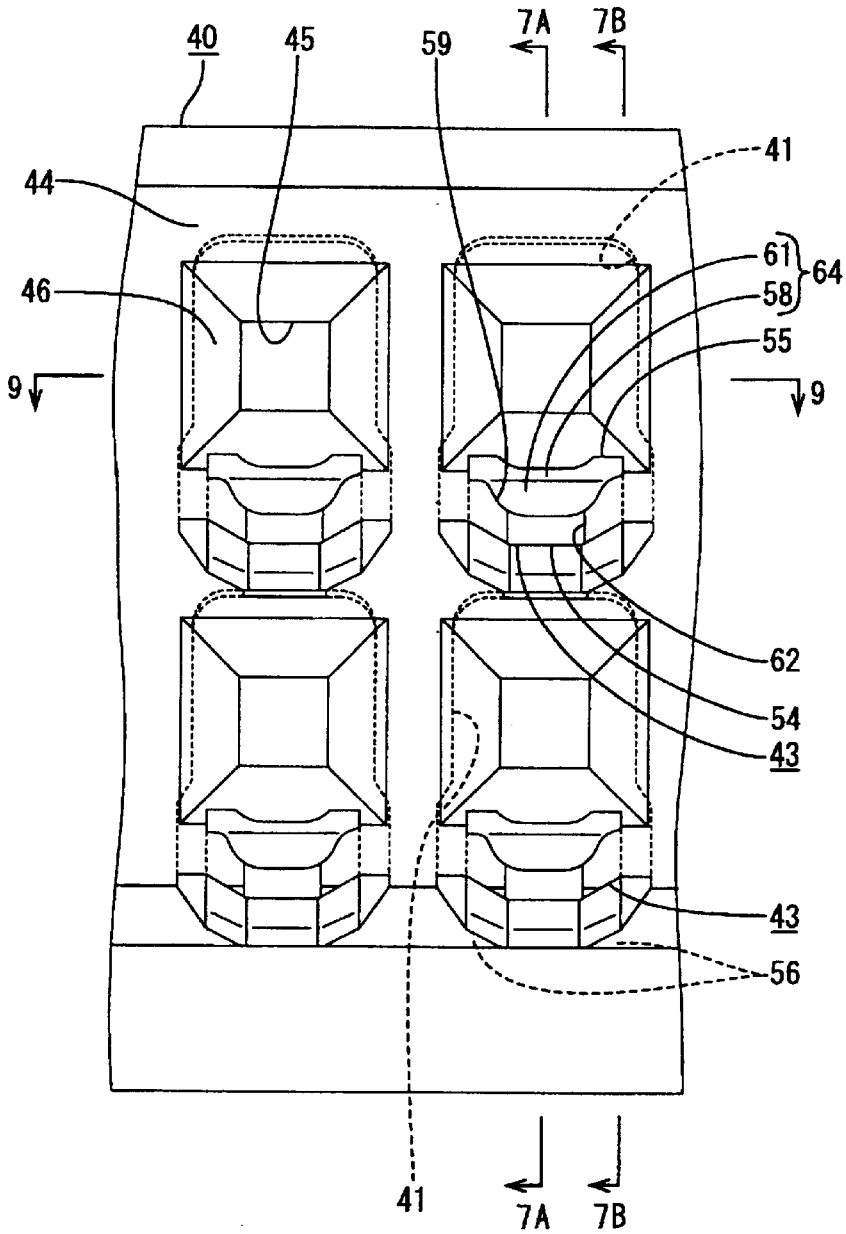
FIG. 1 is a front view of a female housing according to one embodiment of the invention.
Figure 2:
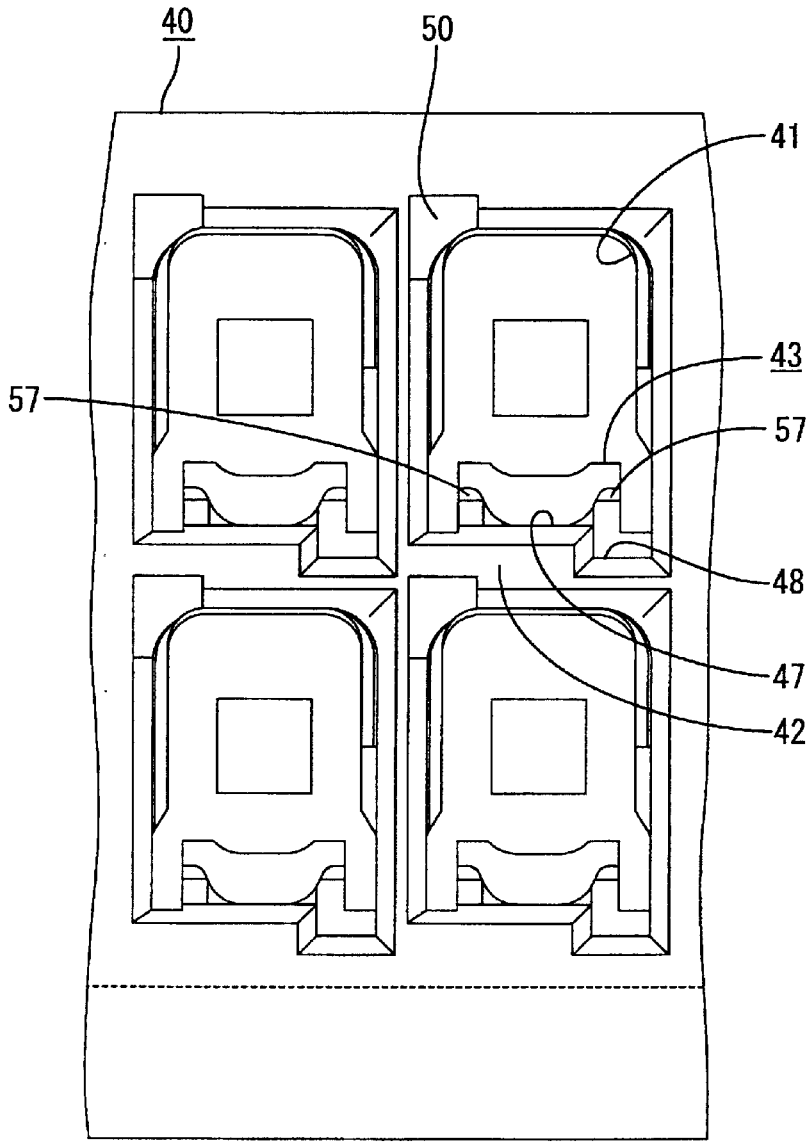
FIG. 2 is a rear view of the female housing.

The female housing 40 is molded of a resin and cavities 41 are arranged substantially side-by-side at two stages in the female housing 40, as shown in FIGS. 1, 2 and 7. Each cavity 41 has a bottom wall 42, and a lock 43 projects from the bottom wall 42 into each cavity 41. Each lock 43 is configured to engage the female terminal fitting 10 that has been inserted into the cavity 41. The female housing 40 also has a front wall 44 that defines a front-limit position for the terminal fittings 10 in the cavity 41. The front wall 44 of the female housing 40 is formed with tab insertion holes 45 for receiving tabs of the mating male terminal fittings that are inserted into the cavities 41 from the front. Converging or tapered guide surfaces 46 are formed at the front edges of the tab insertion holes 45 over substantially the entire periphery, so that the tabs can be guided smoothly into the cavities 41.

A projection-inserting groove 47 is formed substantially in the widthwise center of the bottom wall 42, and a stabilizer-inserting groove 48 is formed at the right side of the projection-inserting groove 47 in FIG. 2. The stabilizer-inserting groove 48 is deeper than the projection-inserting groove 47, and both grooves have open rear ends. The projection-inserting groove 47 is dimensioned and disposed to receive the locking projection 29 and the projection 27 of the female terminal fitting 10 and the stabilizer-inserting groove 48 is dimensioned and disposed to receive the stabilizer 25. The projection-inserting groove 47 is substantially continuous with the lock 43, as described below, whereas the front end of the stabilizer-inserting groove 48 is slightly behind the lock 43.

Figure 9:
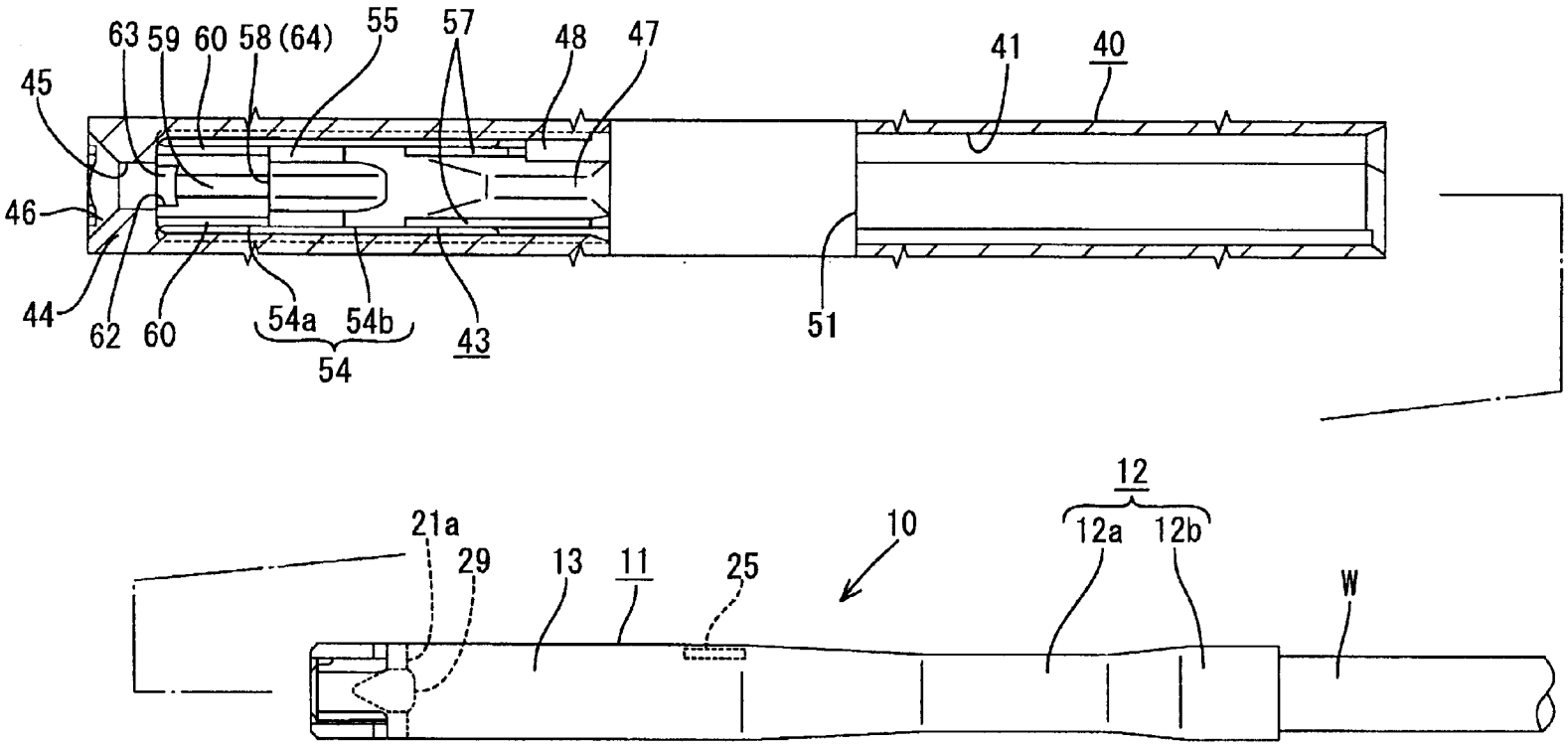
FIG. 9 is a cross sectional view of the female housing taken along line 9—9 of FIG. 1 and with the female terminal fitting is shown by a plan view in a state before the female terminal fitting is inserted into the female housing with the retainer mounted at the partial locking position.
Figure 10:
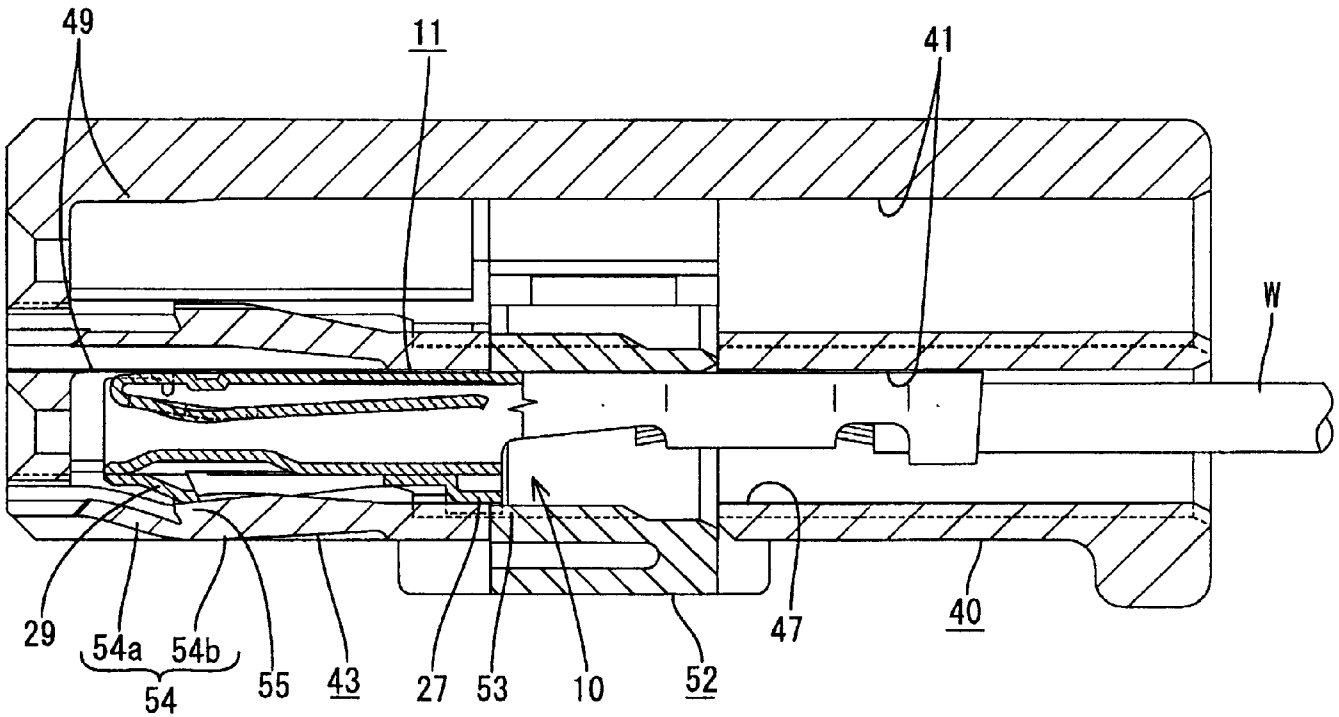
FIG. 10 is a sectional view similar to FIG. 7 but showing an intermediate stage of insertion of the female terminal fitting into the female housing.

A projection 49 is provided at the front end of the upper surface of the cavity 41 and gradually projects down toward the lock 43 over the entire width of the cavity 41. The projection 49 pushes the front end of the female terminal fitting 10 toward the lock 43 as the female terminal fitting 10 is inserted into the cavity 41, and hence increases the depth of engagement with the lock 43. The peripheral edge of the rear end of the cavity 41 is inclined in and to the front over substantially the entire periphery to guide the female terminal fitting 10. A restriction 50 is at an upper-left position of the peripheral edge of the rear end of the cavity 41 in FIG. 2 and extends at an angle to the inserting and withdrawing directions IWD of the female terminal fitting 10. The restriction 50 contacts the stabilizer 25 when the female terminal fitting 10 is inserted improperly into the cavity 41, thereby hindering insertion. Further, opposite sidewalls of the cavity 11 bulge so that a substantially front half is narrower than a substantially rear half as shown in FIG. 9.

A retainer mount hole 51 is formed in the bottom wall of the female housing 40, as shown in FIG. 7, and receives a retainer 52 is mountable from below for doubly locking the female terminal fittings 10. This retainer mount hole 51 laterally exposes longitudinal middle portions of the respective cavities 41 e.g. to outside below. The retainer 52 includes fastening portions 53 arrayed at two stages and substantially corresponding to the respective cavities 41, and is vertically movable between two positions in the female housing 40, namely, a partial locking or first position (see FIG. 7) where the respective fasteners 53 are retracted down from the corresponding cavities 41 to permit the insertion and withdrawal of the female terminal fittings 10 into and from the cavities 41. The retainer 52 also can be moved to a full locking position (see FIG. 14) where the respective fasteners 53 enter the corresponding cavities 41 to lock the female terminal fittings 10. The retainer 52 can be held selectively at the partial locking position and the full locking position by an unillustrated holder.

Figure 3:
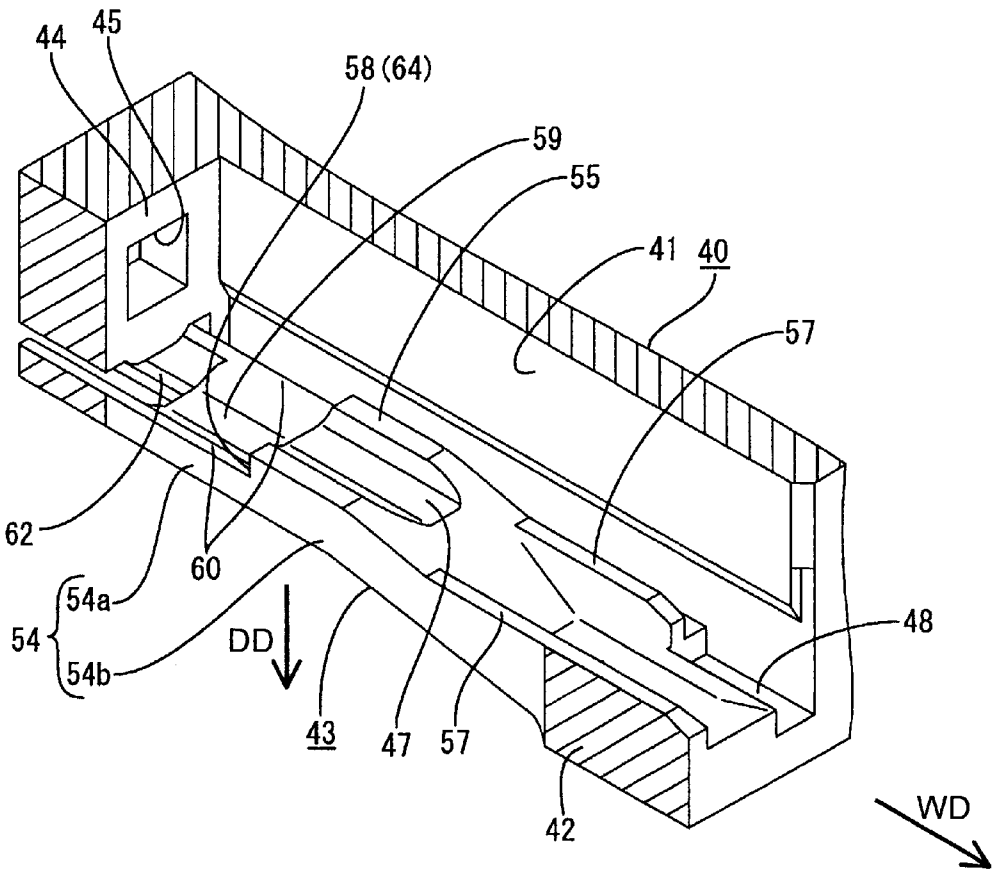
FIG. 3 is a perspective view partly in section of the female housing.

The lock 43 is at the front of the bottom wall 42 of the cavity 41 and has an arm 54 supported at both front and rear ends. A fastening projection 55 projects into the cavity 41 from the upper surface of the arm 54, as shown in FIGS. 3 and 7. The fastening projection 55 can enter the cut-away portion 21 of the female terminal fitting 10 to engage the front cut end surface 21*a*. The lock 43 is substantially transversely symmetrical when viewed from the front.

The arm 54 is slightly narrower than the cavity 41 (see FIG. 9) and has its opposite bottom ends chamfered (see FIG. 1). The arm 54 is resiliently deformable in a vertical deformation direction DD that intersects the inserting and withdrawing directions IWD of the female terminal fitting 10. Front and rear ends define the supports about which the arm 54 deflects. Thus, the arm 54 has a substantially arch shape and a longitudinal middle portion of the arm 54 is at a bottommost position (see FIG. 10) during the deformation. A deformation permitting space is provided below the arm 54 to permit resilient deformation of the arm 54, and excessive deformation preventing rails 56 are spaced below the opposite chamfered sides of the arm 54 by the height of the deformation permitting space. The excessive deformation preventing rails 56 have a substantially triangular cross section extend along the longitudinal direction of the lock 43. The excessive deformation preventing rails 56 prevent excessive resilient deformation of the lock 43 by engaging the lock 43 before the lock 43 is deformed beyond its resiliency limit. A rear portion 54*b* of the arm 54 is connected with the bottom wall 42 over substantially the entire width and is sloped up toward the front, whereas a front portion 54*a* thereof is connected partly with the front wall 44 of the female housing 40 and is substantially horizontal. The projection-inserting groove 47 in the bottom wall 42 is formed continuously in the rear portion 54*b*, and parts of the rear portion 54*b* left at the opposite sides of the projection-inserting groove 47 serve as rear supports 57 for supporting the female terminal fitting 10 from below.

The fastening projection 55 is as wide as the arm 54 (see FIG. 9). The front end of the fastening projection 55 substantially aligns with the front end of the rear portion 54*b* of the arm 54, and the rear surface the fastening projection 55 is inclined to be continuous with the rear portion 54*b*. The projection-inserting groove 47 in the rear portion 54*b* of the arm 54 is formed continuously in the fastening projection 55. Thus, the widthwise middle of the fastening projection 55 is recessed when viewed from the front (see FIG. 1). The front surface of the fastening projection 55 defines an upper locking surface 58 that is engageable with portions of the front cut end surface 21*a* of the cut-away portion 21 of the female terminal fitting 10 at the opposite sides of the locking projection 29 (see FIG. 12). The upper locking surface 58 is substantially normal to forward and backward directions.

A forwardly open maneuverable groove 59 is formed in the widthwise center of the upper surface of the front portion 54*a* of the arm 54 and extends over substantially the entire length of the front portion 54*a*. The maneuverable groove 59 is configured to receive a disengagement jig J from the front (see FIG. 15) for forcibly deforming the lock 43. Parts of the front portion 54*b* at the opposite sides of the maneuverable groove 59 define front supports 60 for supporting the female terminal fitting 10 from below. Thus, the maneuverable groove 59 makes the front portion 54*a* of the arm 54 thinner than the rear portion 54*b*. The maneuverable groove 59 has a depth slightly over half the thickness of the front portion 54*a* of the arm 54, and opposite side surfaces of the maneuverable groove 59 curve up to opposite outer sides to conform substantially to the outer shape of the arm 54 (see FIG. 1). The locking projection 29 of the female terminal fitting 10 inserted into the cavity 41 enters this maneuverable groove 59. A lower locking surface 61 is formed at the rear end of the maneuverable groove 59 and is substantially continuous with the upper locking surface 58. The lower locking surface 61 is engageable with the rear end of the locking projection 29 of the front cut end surface 21*a* of the cut-away portion 21 of the female terminal fitting 10. This lower locking surface 61 is inclined more backward than the upper locking surface 58.

A jig-introducing groove 62 splits the front half of the front portion 54*a* of the arm 54 and communicates with the maneuverable groove 59 for receiving the disengagement jig J. An upwardly and rearwardly inclined guide surface 63 is formed at the rear end of the jig-introducing groove 62 for guiding the disengagement jig J into the maneuverable groove 59.

A locking surface 64 of the lock 43 for engaging with the female terminal fitting 10 is comprised of the upper and lower locking surfaces 58 and 61, as shown in FIG. 7. The upper locking surface 58 is formed by the front surface of the fastening projection 55, which is the portion of the fastening projection 55 that projects further into the cavity 41. The lower locking surface 61 is formed by the back surface of the maneuverable groove 59. The upper and lower locking surfaces 58, 61 are discontinuous and are aligned at different angles $\alpha$, $\beta$ to the withdrawing direction WD of the female terminal fitting 10. Specifically, the angle $\alpha$ between the lower locking surface 61 and the withdrawing direction WD of the female terminal fitting 10 is 90° or larger, i.e. an obtuse angle. However, the angle $\beta$ between the upper locking surface 58 and the withdrawing direction preferably is about 90°. Accordingly, the angle $\beta$ of the upper locking surface 58 to the withdrawing direction WD is smaller than the angle $\alpha$ of the lower locking surface 61. The angle $\alpha$ of the lower locking surface 61 to the withdrawing direction WD of the female terminal fitting 10 preferably is about the same as an angle of the front cut end surface 21*a* of the cut-away portion 21 of the female terminal fitting 10 thereto.

Figure 8:
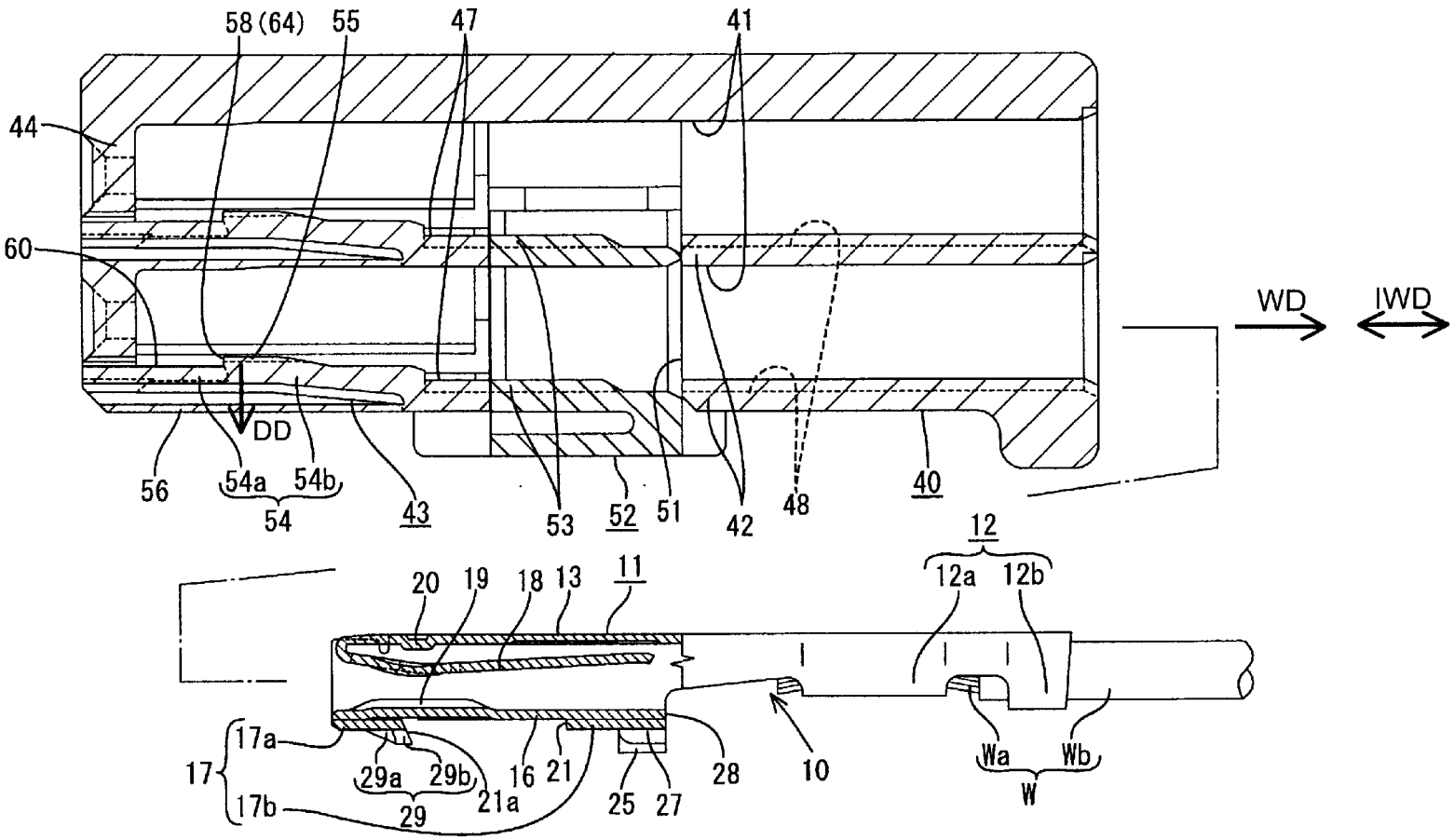
FIG. 8 is a cross sectional of the female housing taken along line 8A—8A of FIG. 1 and of the female terminal fitting taken along 8B—8B of FIG. 4 showing the state before the female terminal fitting is inserted into the female housing with the retainer mounted at the partial locking position.

The connector of the invention is used by first mounting the retainer 52 in the partial locking position in the female housing 40, as shown in FIGS. 7 to 9. The female terminal fitting 10 then is inserted into the cavity 41 from behind with the barrel 12 of the female terminal fitting 10 crimped, bent or folded into connection with the wire W. If an attempt is made to insert the female terminal fitting 10 upside down, the front end surface of the upward-facing stabilizer 25 contacts the restricting portion 50 at the rear end of the cavity 41, thereby hindering insertion of the female terminal fitting 10. In this way, an upside-down insertion of the female terminal fitting 10 is prevented.

Insertion of the properly oriented female terminal fitting 10 into the cavity 41 moves the locking projection 29 into the projection-inserting groove 47. The projection 27 and the stabilizer 25 then enter the projection-inserting groove 47 and the stabilizer-inserting groove 48, respectively so that the female terminal fitting 10 can be inserted smoothly while being prevented from shaking along vertical and transverse directions. When the female terminal fitting 10 is inserted to a specified depth, the lock 43 is pressed by the locking projection 29, and the arm 54 is deformed down in the deformation direction DD and into a shallow V-shape when viewed sideways. Thus, the front portion 54*a* is inclined backward while the rear portion 54*b* is inclined forward. The locking projection 29 is substantially pyramidal and has a vertex at the front end. Thus, the locking projection 29 can be inserted smoothly along the projection-inserting groove 47 and can smoothly press the lock 43.

There are cases where an operator tries to move the retainer 52 to the full locking position before the female terminal fitting 10 has reached a proper depth. In such a case, the fastening portion 53 of the retainer 52 contacts the bottom surface of the main body 11 of the female terminal fitting 10 to prevent the retainer 52 from moving to the full locking position. Thus, the insufficient insertion of the female terminal fitting 10 can be detected.

Figure 11:
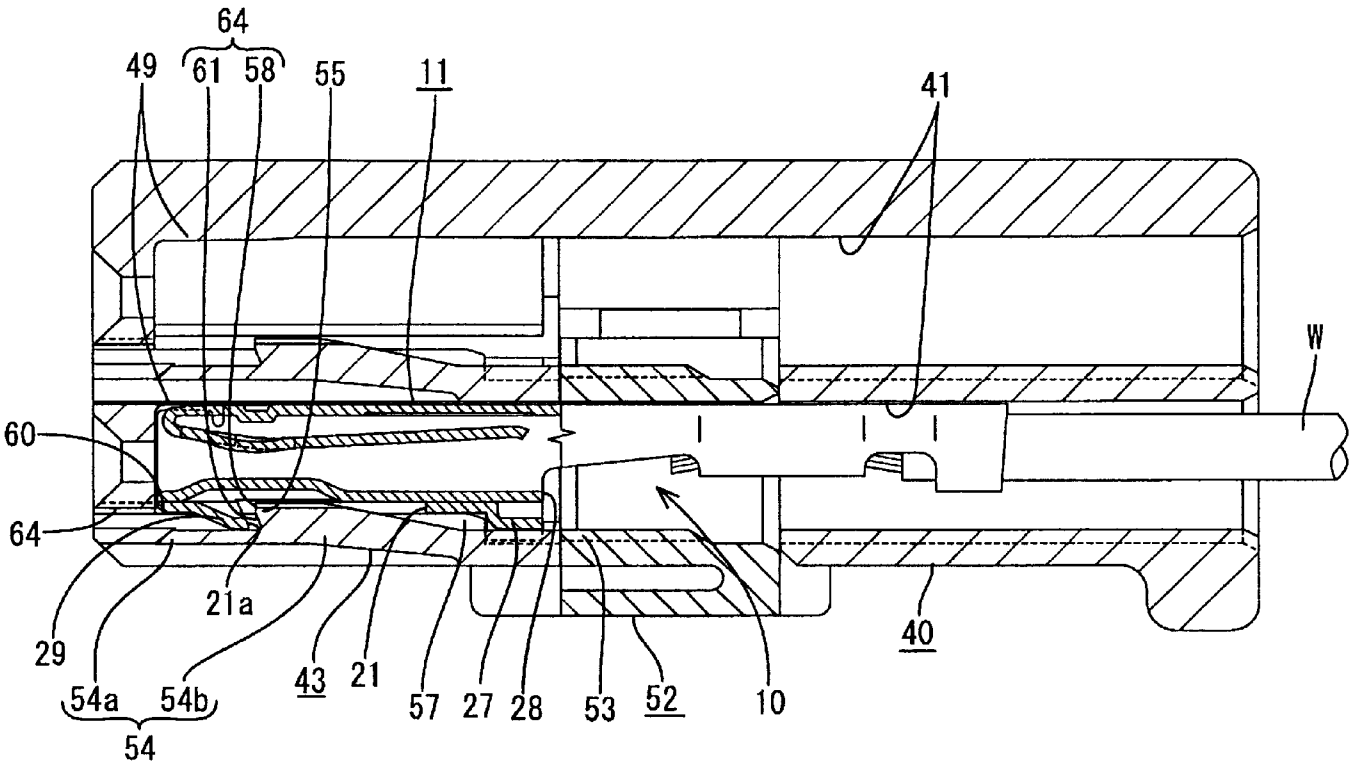
FIG. 11 is a sectional view similar to FIG. 7 but showing a state where the female terminal fitting is inserted in the female housing.
Figure 12:
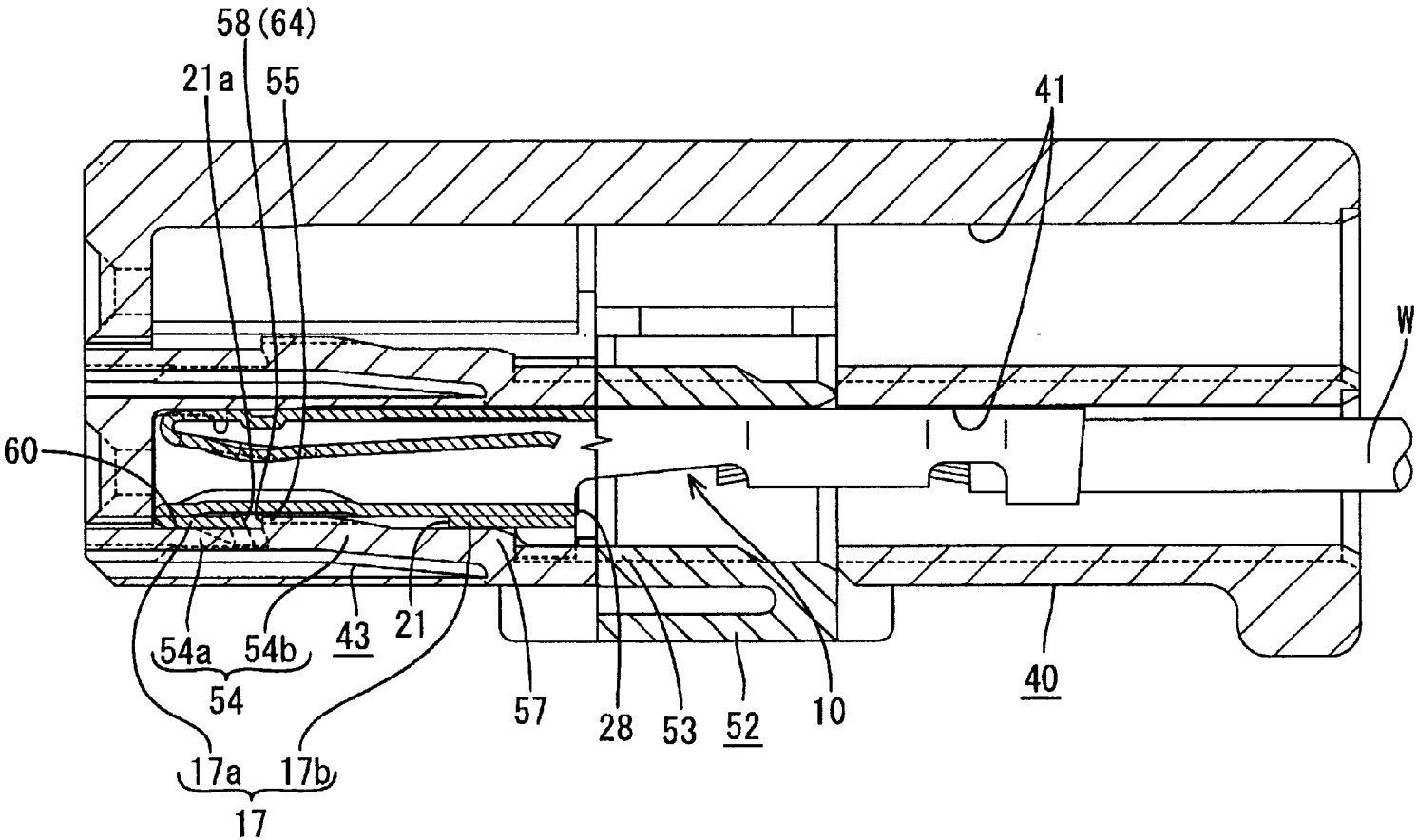
FIG. 12 is a section view similar to FIG. 8, but showing the state where the female terminal fitting is inserted in the female housing.
Figure 13:
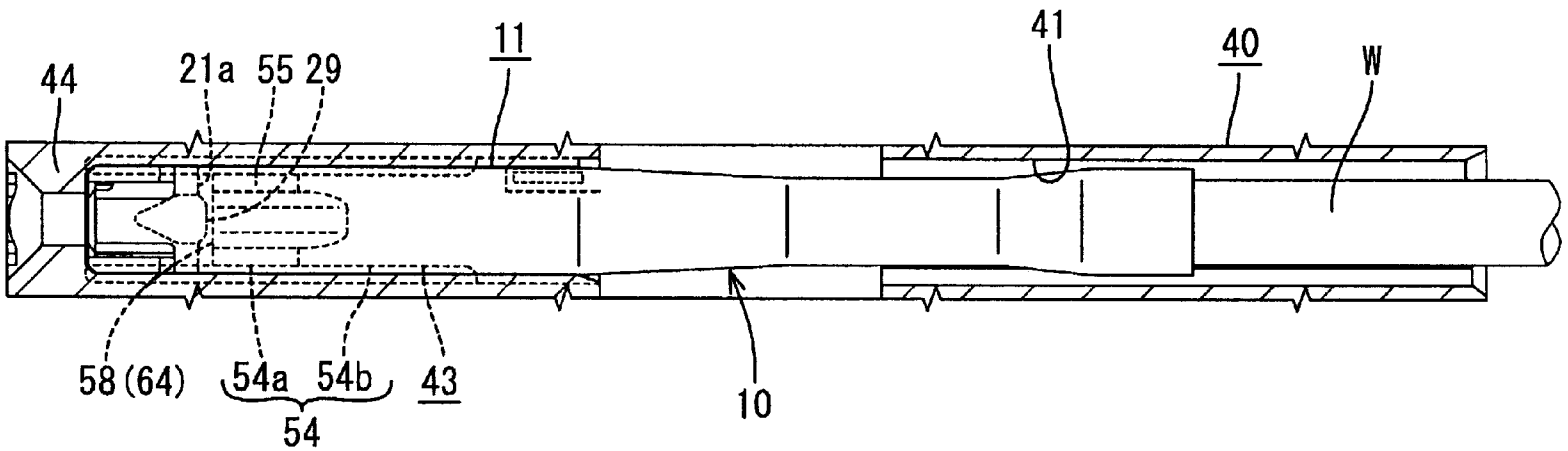
FIG. 13 is a sectional view similar to FIG. 9 showing the state where the female terminal fitting is inserted in the female housing.

The locking projection 29 moves beyond the fastening projection 55 and enters the maneuverable groove 59 when the female terminal fitting 10 is inserted to the proper depth in the cavity 41, as shown in FIGS. 11 to 13, whereupon the lock 43 is restored resiliently. The fastening projection 55 of the lock 43 then enters the cut-away portion 21, the lower locking surface 61 engages the rear edge of the locking projection 29 of the front cut end surface 21*a* of the cut-away portion 21 (see FIG. 11), and the upper locking surface 58 engage the portions of the front cut end surface 21*a* of the cut-away portion 21 at the opposite sides of the locking projection 29 (see FIG. 12). In this way, the female terminal fitting 10 is held by the lock 43 so as not to come out. In the process of properly inserting the female terminal fitting 10, a depth of engagement of the lock 43 with the female terminal fitting 10 is increased since the front end of the main body 11 is pushed down toward the lock 43 by the jutting portion 49 on the ceiling surface of the cavity 41.

The upper locking surface 58 of the lock 43 defines the maximum width of the lock 43, and the front cut end surface 21*a* of the cut-away portion 21 of the female terminal fitting 10 extends over the entire width of the female terminal fitting 10. Thus, the female terminal fitting 10 is held in the cavity 41 by a strong locking force. Further, the front cut end surface 21*a* of the cut-away portion 21 and the lower locking surface 61 both are inclined at obtuse angles to the withdrawing direction of the female terminal fitting 10. Thus, even if a force on the wire W acts to pull the locked female terminal fitting 10 back, a component of force acts on the lock 43 in an obliquely upward direction to the back, which is substantially opposite the downward deforming direction DD. Thus, it is difficult to disengage the lock 43, and a force to lock the terminal fitting 10 is made even stronger.

Figure 14:
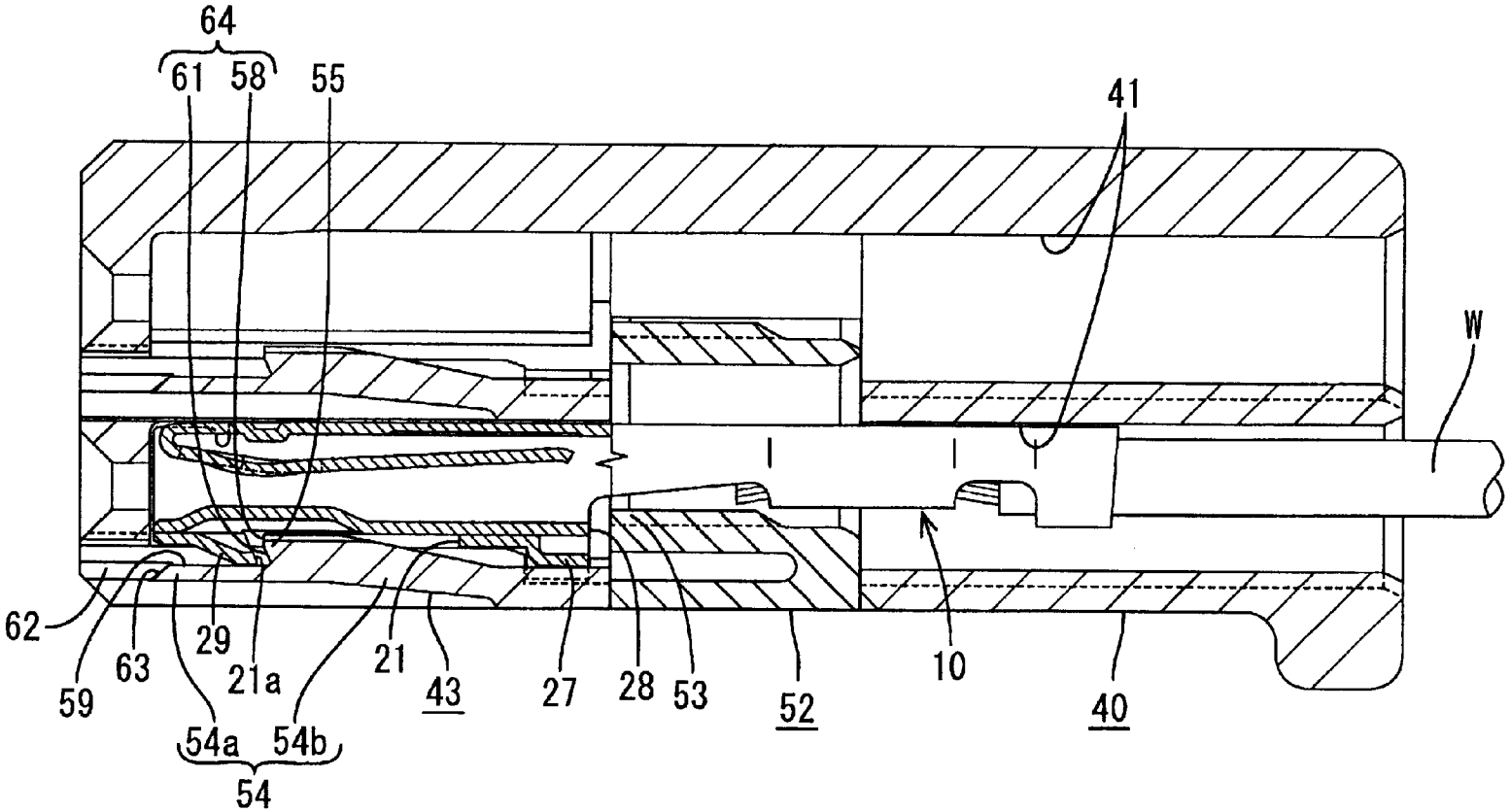
FIG. 14 is a side view similar to FIG. 7, but showing a state where the retainer is moved to a full locking position.

The retainer 52 is moved to the full locking position, as shown in FIG. 14, after all the female terminal fittings 10 are inserted properly into the corresponding cavities 41, and the fastening portions 53 enter the corresponding cavities 41 to engage the stepped portions 28 including the projections 27. In this way, the female terminal fittings 10 are locked doubly in the cavities 41 by the locks 43 and the retainer 52.

The terminal fitting 10 may have to be withdrawn from the female housing 40 for maintenance or other reason. In such a case, the retainer 52 is returned from the full locking position to the partial locking position, as shown in FIG. 11. The lock 43 then is deformed by inserting the disengagement jig J into the jig-introducing groove 62 and the maneuverable groove 59. An initial inserting operation can be performed easily since a wide entrance for the disengagement jig J is provided by the jig-introducing groove 62. Further, the back surface of the jig-introducing groove 62 is formed into the guide surface 63, which is inclined toward the maneuverable groove 59. Thus, the disengagement jig J can be guided smoothly to the maneuverable groove 59.

Figure 15:
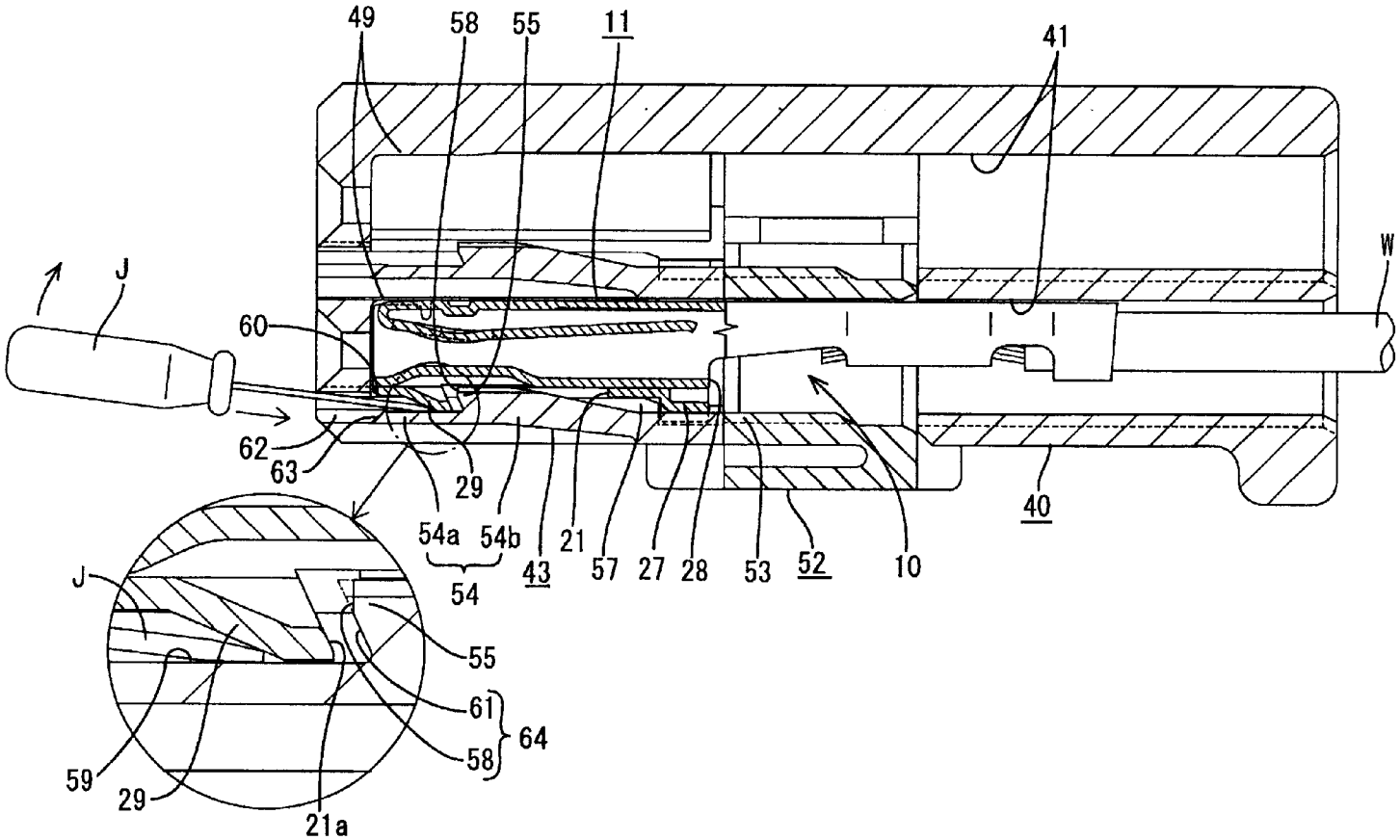
FIG. 15 is a sectional view similar to FIG. 7, but showing a state where a disengagement jig is inserted in a maneuverable groove.
Figure 16:
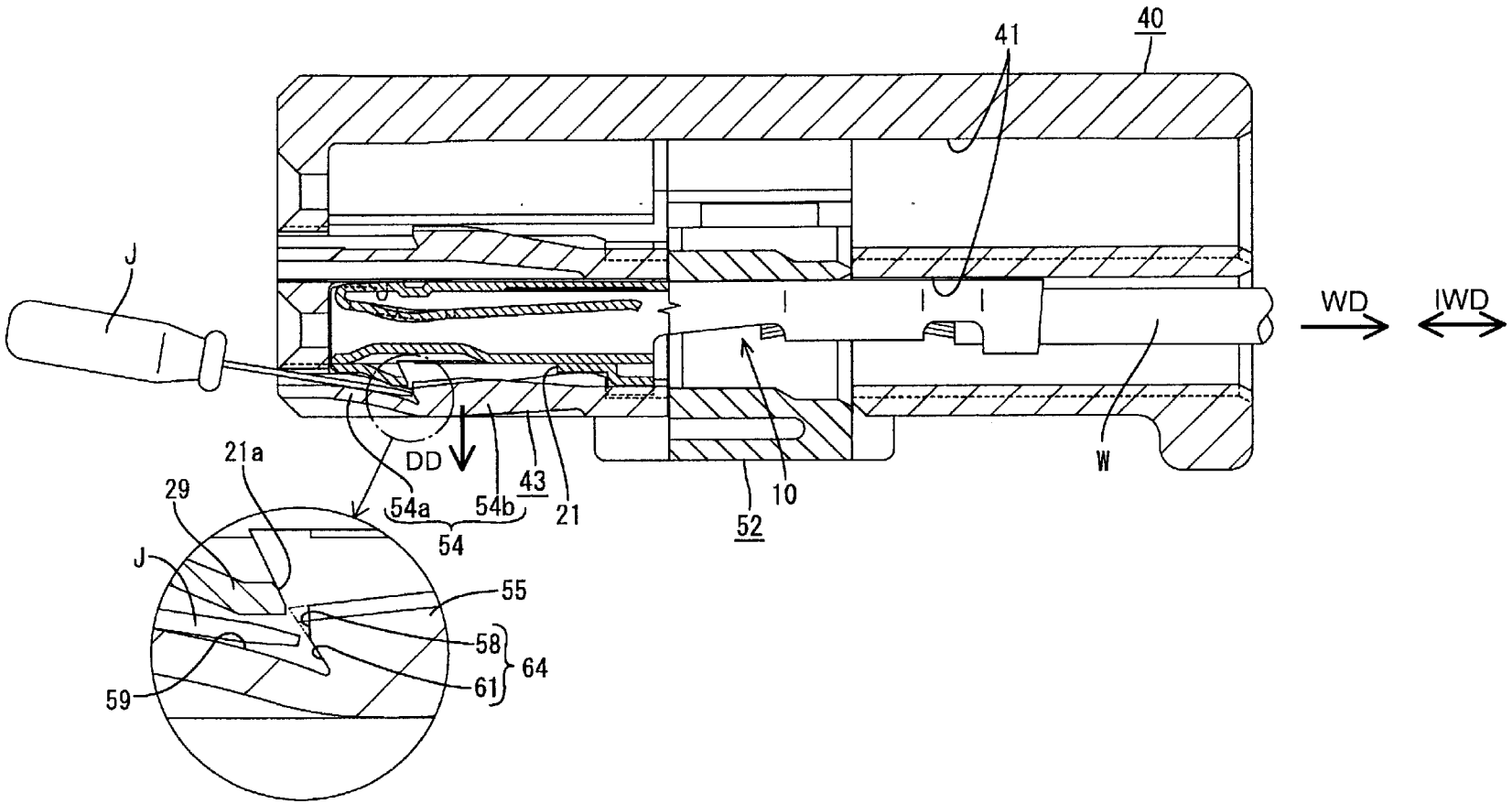
FIG. 16 is a sectional view similar to FIG. 7, but showing a state where a lock is resiliently deformed by the disengagement jig.
Figure 17:
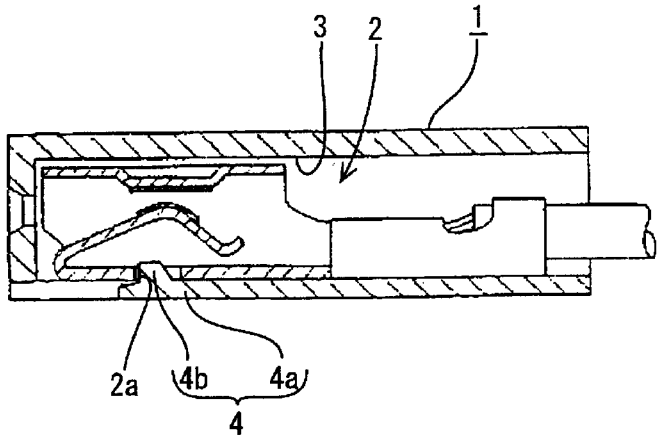
FIG. 17 PRIOR ART
FIG. 17 is a section of a prior art connector.
Figure 18:
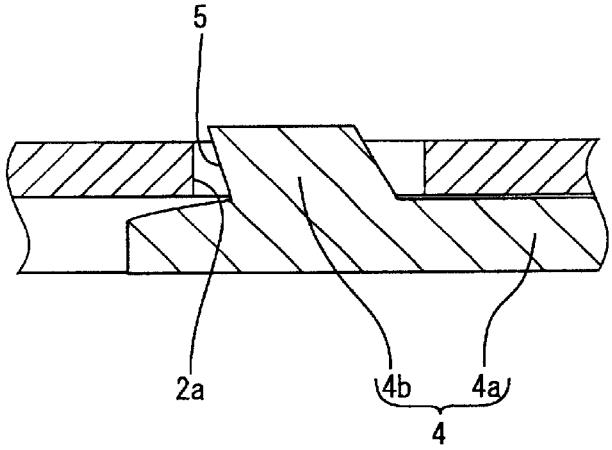
FIG. 18 PRIOR ART
FIG. 18 is a partial section showing improved prior art connector.

The disengagement jig J is inserted to the back of the maneuverable groove 59 and moved along the inclination of the outer surface of the locking projection 29, as shown in FIG. 15. Thus, the leading end of the disengagement jig J pushes the wall surface of the maneuverable groove 59 down to deform the arm 54, as shown in FIG. 16. The wire W is gripped and pulled back in the withdrawal direction WD when the lock 43 is deformed away from the female terminal fitting 10, and the female terminal fitting 10 can be pulled out of the cavity 41.

The angle $\alpha$ of the upper locking surface 58 of the locking surface 64 to the withdrawing direction of the female terminal fitting 10 is smaller than the angle $\beta$ of the lower locking surface 61 thereto. Therefore, a trace of displacement of the locking surface 64 during the deformation of the lock 43 is further back than a locking surface that has the same angle of inclination over the entire length, as shown by phantom line in FIGS. 15 and 16. Thus, the locking surface 64 is less likely to interfere with the locking projection 29 during the deformation of the locking surface 64. Even if the locking surface 64 should interfere with the locking projection 29, it is caught more lightly than the one shown by phantom line. Therefore, the lock 43 can be deformed and the interference is overcome easily by slightly pushing the female terminal fitting forward via the wire W.

That the trace of displacement of the locking surface 64 during the deformation of the lock 43 is further back means a smaller clearance between the locking surface 64 of the lock 43 and the front cut end surface 21*a* of the cut-away portion 21 of the female terminal fitting 10 when the female terminal fitting 10 is inserted to a proper depth in the cavity 41 (see FIG. 11). Thus, a range within which the female terminal fitting 10 may shake forward and backward while being properly inserted in the cavity 41 becomes smaller. This reduces the possibility of making the electrical connection between the female terminal fitting 10 and the mating terminal fitting unstable.

As described above, the lower locking surface 61 is inclined at an obtuse angle to the withdrawing direction WD of the female terminal fitting 10. Thus, even if a force acts to pull the locked terminal fitting 10 back, a component of force acts on the lock 43 in a direction substantially opposite the deforming direction DD, making it difficult to disengage the lock 43. As a result, a force to lock the terminal fitting 10 can be increased. On the other hand, the angle $\beta$ of the upper locking surface 58 with respect to the withdrawing direction WD of the terminal fitting 10 is smaller than the angle $\alpha$ of the lower locking surface 61 thereto. Thus, the trace of displacement of the locking surface 64 during deformation of the lock 43 can be more backward as compared to a locking surface having the same angle of inclination over the entire length. Thus, the lock 43 is less likely to interfere with the terminal fitting 10 during the deformation of the lock 43 at the time of detaching the terminal fitting 10, and the terminal fitting 10 can be detached more reliably. Therefore, a large locking force can be secured for the female terminal fitting 10 even if the strength of the lock 43 is lowered as a result of miniaturization and the detaching operability of the female terminal fitting 10 can be improved.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the angle of the upper locking surface to the withdrawing direction of the female terminal fitting is about 90° in the foregoing embodiment, it may be larger than or smaller than 90° provided that this angle is smaller than the angle of the lower locking surface to the withdrawing direction WD.

The upper locking surface is on the fastening projection and the lower locking surface is on the arm in the foregoing embodiment. However, both upper and lower locking surfaces may be provided on the fastening projection.

Although a lock supported at both ends is described above, the invention is also applicable to locks supported only at one end.

The female terminal fitting has the locking projection in the foregoing embodiments. However, connectors in which female terminal fittings having no locking projection also are embraced by the present invention.

Although the female connector in which the female terminal fittings are accommodated in the female housing is described in the foregoing embodiment, the present invention is also applicable to male connectors in which male terminal fittings are accommodated in a male housing.

What is claimed is:

1. A connector comprising a housing with at least one cavity, a terminal fitting being inserted along an inserting direction into the cavity and being withdrawable along a withdrawing direction, a lock formed in the housing and projecting into the cavity, the lock being deformable in a deforming direction in response to insertion of the terminal fitting into the cavity and returning resiliently toward an undeformed position for locking the terminal fitting in the cavity, the deforming direction intersecting the inserting direction, the lock having an inner surface facing into the cavity and aligned substantially along the withdrawing direction, the lock further having a locking surface for engaging the terminal fitting, the locking surface comprising a deforming-direction front section and a deforming-direction rear section, the deforming-direction rear section projecting farther into the cavity than the deforming-direction front section and being aligned to the withdrawing direction of the terminal fitting at an angle that is smaller than an angle of the deforming-direction front section to the withdrawing direction of the terminal filling, the deforming-direction rear section extending to and intersecting with the inner surface of the lock.

2. The connector of claim 1, wherein the angle of the deforming-direction front section is an obtuse angle to the withdrawing direction of the terminal fitting.

3. The connector of claim 2, wherein the angle of the deforming-direction rear section is substantially normal to the withdrawing directions of the terminal fitting.

4. The connector of claim 1, wherein the terminal fitting comprises a locking projection that is engageable with the deforming-direction front section of the locking surface for locking.

5. The connector of claim 1, wherein the terminal fitting has a locking section engageable by the lock and aligned substantially parallel to the deforming-direction front section.

6. A connector, comprising a housing with opposite front end and rear ends and at least one cavity extending between the ends, a terminal fitting being inserted along an inserting direction into the cavity and being withdrawable along a withdrawing direction, an elongated lock formed in the housing and aligned substantially along the inserting direction, a partion of the lock projecting into the cavity, the lock being deformable in a deforming direction that intersects the inserting direction in response to insertion of the terminal fitting into the cavity and returning resiliently toward an undeformed position for locking the terminal fitting in the cavity, the lock having a locking surface for engaging the terminal fitting, the locking surface comprising a deforming-direction front section and a deforming-direction rear section, the deforming-direction rear section being aligned to the withdrawing direction of the terminal fitting at an angle that is smaller than an angle of the deforming-direction front section to the withdrawing direction of the terminal fitting, wherein the lock is supported at both longitudinal ends.

7. The connector of claim 6, wherein the housing is formed with an opening which is open forward, and wherein a section of the lock projecting more forward than the locking surface is connected with at least one side surface of the opening.

8. The connector according to claim 7, wherein the section of the lock projecting more forward than the locking surface is formed with a maneuverable groove which is open forward and is maneuverable by a disengagement jig to forcibly resiliently deform the lock.

9. The connector of claim 8, wherein the disengagement jig can be inserted into the opening for maneuvering the maneuverable groove.

10. The connector of claim 9, wherein the opening forks the section of the lock projecting more forward than the locking surface.

* * * * *